US007204462B2

(12) United States Patent
Lembo

(10) Patent No.: US 7,204,462 B2
(45) Date of Patent: Apr. 17, 2007

(54) EXPANDING HOSE HOLDER

(75) Inventor: Michael J. Lembo, Souderton, PA (US)

(73) Assignee: Certainteed Corporation, Valley Forge, PA (US)

( * ) Notice: Subject to any disclaimer, the term of this patent is extended or adjusted under 35 U.S.C. 154(b) by 36 days.

(21) Appl. No.: 10/830,728

(22) Filed: Apr. 23, 2004

(65) Prior Publication Data

US 2005/0236529 A1 Oct. 27, 2005

(51) Int. Cl.
*A62C 13/76* (2006.01)

(52) U.S. Cl. ..... 248/75; 241/57

(58) Field of Classification Search ..... 248/75, 248/629, 298.1; 241/57; 52/742.13
See application file for complete search history.

(56) References Cited

U.S. PATENT DOCUMENTS 1,716,305 A * 6/1929 George ..... 239/229
2,045,336 A * 6/1936 Skoglund ..... 248/80
2,200,713 A * 5/1940 Ericson et al. ..... 52/742.13
3,559,227 A * 2/1971 Schleicher ..... 15/250.04
4,236,654 A 12/1980 Mello
4,541,327 A * 9/1985 Lundstrom ..... 454/63
4,560,307 A 12/1985 Deitesfield
4,880,166 A 11/1989 Suttner
4,978,252 A 12/1990 Sperber
5,150,866 A * 9/1992 Karpisek ..... 248/79
5,181,294 A * 1/1993 Campbell et al. ..... 15/315
5,421,922 A 6/1995 Sperber
5,560,583 A * 10/1996 Holmgren ..... 248/652
5,639,033 A 6/1997 Miller et al.
5,738,148 A * 4/1998 Coral et al. ..... 138/120
6,049,658 A 4/2000 Schave et al.
6,648,022 B2 11/2003 Pentz et al.
6,764,394 B2 * 7/2004 Sharifi et al. ..... 454/64

* cited by examiner

*Primary Examiner*—Anita M. King
(74) *Attorney, Agent, or Firm*—Duane Morris LLP

(57) ABSTRACT

An insulation delivery apparatus has a hose holder and a nozzle section holder, the nozzle section holder being mounted on an extensible section of the hose holder.

20 Claims, 4 Drawing Sheets

EXPANDING HOSE HOLDER

FIELD OF THE INVENTION

The invention relates to apparatus for delivering insulation, and more particularly, to apparatus for delivering impelled insulation by reaching the apparatus to a confined space or a distant location.

BACKGROUND

U.S. Pat. No. 4,236,654 and U.S. Pat. No. 5,421,922 each discloses apparatus for impelling insulation under pressure through a hose and outwardly from a nozzle connected to the hose. Operators must grasp the nozzle and the hose by hand to point the nozzle and direct the impelled insulation to fill a space in a building. The operators have difficulty extending their arms and hands to extend the nozzle to reach certain locations. An example of such a location is a confined space, for example, an attic space that is confined by rafters intersecting with purlins. Other examples of such a location are distant locations, for example, a location around a structural corner, and an overhead space beyond the reach of the operators.

Operators must be able to turn off the apparatus for impelling the insulation, when they observe that it would be necessary to cease delivery of insulation through the hose and the nozzle. Accordingly, the operators carry with them, an electrical machine control switch connected to an electrical extension cord for turning off the apparatus.

SUMMARY OF THE INVENTION

The invention resides in apparatus for delivering insulation. The apparatus has a hose and a nozzle section through which insulation is impelled, and a manually graspable holder for holding the hose and the nozzle section. The hose is slidably held by a hose holder of the holder. The nozzle section of the hose is held by a nozzle section holder. Further the holder has an extensible section connecting the nozzle section holder to the hose holder. The extensible section can be extended to extend the nozzle section to distant locations and confined spaces.

According to an embodiment of the invention, the hose holder is a ring through which the hose extends. Further, the hose extends slidably through the ring.

According to an embodiment of the invention, the nozzle section holder is a ring clamp that is attached to the nozzle section.

An embodiment of the extensible section comprises an extensible cantilever beam having multiple cantilever beam sections that are slidably mounted to one another for lengthwise extension. The cantilever beam sections are slidable one within another to form a compact stack. The cantilever beam sections telescopically support one another, when each cantilever beam section extends as a cantilever beam.

According to another embodiment of the present invention, the cantilever beam sections are telescopic sections that telescope one within another.

According to another embodiment of the invention, the cantilever beam sections are pairs of crossing beams. The crossing beams pivot where they cross one another, and the pairs are pivotally connected end to end, for extending as an unfolding, cantilever beam.

According to another embodiment of the invention, the nozzle section holder is a strap.

According to another embodiment of the invention, the nozzle section holder is a disconnect coupling.

DETAILED DESCRIPTION

Figure 1:
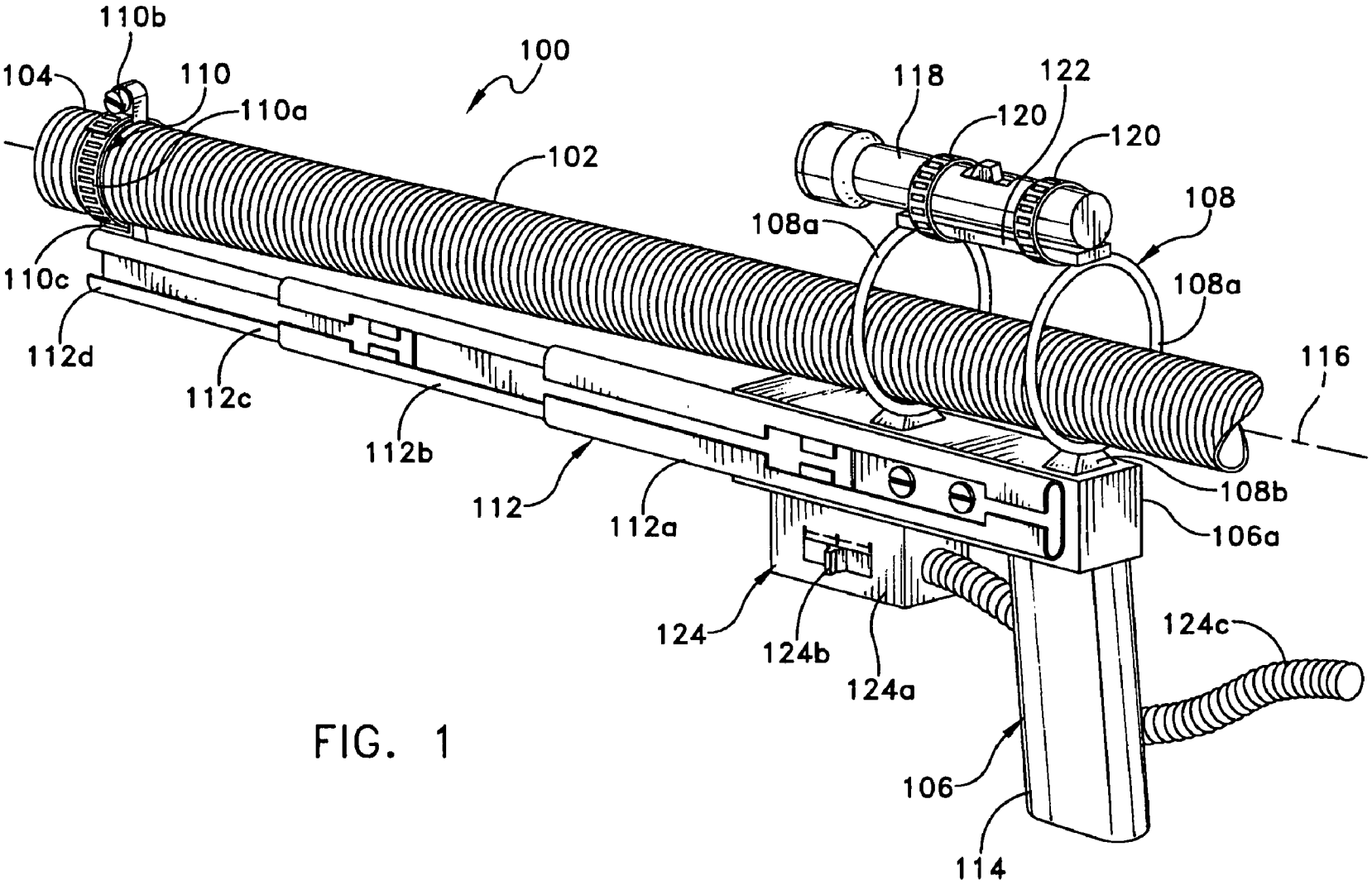
FIG. 1 is an isometric view of an apparatus for delivering insulation.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 discloses a portion of an insulation delivery apparatus (100) for delivering insulation. The insulation is in a dispensable form, such as granules, foam or fibers. The apparatus (100) has a hose (102) and a nozzle section (104) through which insulation is impelled, and a manually graspable holder (106) for holding the hose (102) and the nozzle section (104). For example, an embodiment of the hose (102) is disclosed by FIG. 1 as a corrugated plastic tube having a nozzle section (104) that is merely an end portion of the hose (102) with an un-constricted passage, which dispenses the insulation, without substantially increasing the unit pressure at the nozzle section (104), relative to the unit pressure in the hose (102). Other embodiments of the nozzle section (104) can have constricted passages, not shown, which dispense the insulation at an increased unit pressure relative to that in the hose (102). A known machine apparatus, for impelling the insulation under air pressure along a hose, is disclosed, by way of example, in U.S. Pat. No. 4,236,654, incorporated herein by reference.

With continued reference to FIG. 1, The holder (106) has a hose holder (108). The hose is slidably held by the hose holder (108). For, example, the hose holder (108) is an annular ring (108*a*) mounted by a mounting block (108*b*) to a frame (106*a*) of the holder (106). The holder (106) has a nozzle section holder (110). The nozzle section holder (110) is attached to the nozzle section (104). For example, the nozzle section holder (110) is a tightened ring clamp (110*a*)

that encircles the nozzle section (104). The ring clamp (110*a*) is tightened about the nozzle section (104) by a coupling nut (110*b*).

Further the holder (106) has an extensible section (112) of the holder (106). The extensible section (112) connects the nozzle section holder (110) to the hose holder (108). The extensible section (112) can be extended to extend the nozzle section (104) to distant locations and confined spaces. The hose (102) is required to slide relative to the hose holder (108) to extend the hose (102) outwardly to follow the nozzle section (104) outwardly to a distant location or a confined space.

The extensible section (112) disclosed by FIG. 1 has telescopic sections (112*a*), (112*b*) and (112*c*) in the form of channels that fit one within another, and are slidably extensible in a cantilever beam arrangement. Thus, an embodiment of the extensible section (112) comprises an extensible cantilever beam having multiple cantilever beam sections (112*a*), (112*b*) and (112*c*) that are slidably mounted to one another for lengthwise extension. The cantilever beam sections (112*a*), (112*b*) and (112*c*) are slidable one within another to form a compact stack. The cantilever beam sections (112*a*), (112*b*) and (112*c*) telescopically support one another, when each cantilever beam section (112*a*), (112*b*) and (112*c*) extends as a cantilever beam.

The nozzle section holder (110) that is in the form of a clamp ring or ring clamp (110*a*) is mounted by a mounting block (110*c*) to an end portion (112*d*) of the endmost cantilever beam section (112*c*). The ring clamp (110*a*) is in the form of a strap that encircles the nozzle section (104), and is tightened by turning a threaded fastener.

Further, the holder (106) has a manually graspable grip (114) that extends transversely of the longitudinal axis (116) of the hose (102). The grip (114) can extend in a direction that is most convenient for an operator. An operator holds onto the grip (112) with one hand, and with a second hand, manipulates the extensible section (112) to extend the extensible section (112) or to retract the extensible section (112). For example, an operator manually pulls the cantilever beam section (112*c*) outwardly to extend it slidably outward from the cantilever beam section (112*b*), which extends the nozzle section (104) to a distant location or a confined space, with the hose (102) sliding through the hose holder (108) to follow the nozzle section (104). Further, the operator can manually pull the cantilever beam section (112*b*) to extend it slidably outward from the cantilever beam section (112*a*), which extends the nozzle section (104) to reach an inaccessible location, with the hose (102) sliding through the hose holder (108) to follow the nozzle section (104). Each of the extensible sections (112*b*) and (112*c*) is retracted telescopically by the operator to move the nozzle section (104) to a closer location.

With continued reference to FIG. 1, the insulation delivery apparatus (100) provides at least one place to mount a source of illumination (118) for example, a battery powered flashlight, to illuminate a location surrounding the nozzle section (104). The flashlight is removably attached by releasable tape or ring clamps (120) to a mounting block (122). The mounting block (122) is attached to the apparatus (100), for example, to a pair of the rings (108*a*), or, alternatively, to another practical location on the apparatus (100), for example, the far end of the nozzle section (104) or on the nozzle section holder (110) or on the end of the cantilever beam section (112*c*) or (112*d*).

With continued reference to FIG. 1, the frame (106*a*) of the holder (106) provides a place to mount an electrical switch (124). The switch (124) is contained by a metal switch box (124*a*) connected to an electrical cable (124*c*) that is preferably armor shielded. The switch (124) is a control switch for operating the machine apparatus for impelling the insulation through the hose (102) and the nozzle section (104). The switch (124) is three-position type having a lever switch (124*b*) that is moved by an operator to three positions. A first position is the off position. A second position turns on air only for delivery through the hose (102) and the nozzle section (104). A third position of the lever switch (124*b*) turns on the delivery of insulation, only after the air has been turned on by movement of the switch lever (124*b*) through the second position. Returning the lever switch (124*b*) to the second position from the third position, ceases insulation delivery while the air remains turned on. Thus, the air is turned on to prevent clogging of the hose (102) and nozzle section (104) before insulation delivery, and after insulation delivery has ceased.

Figure 2B:
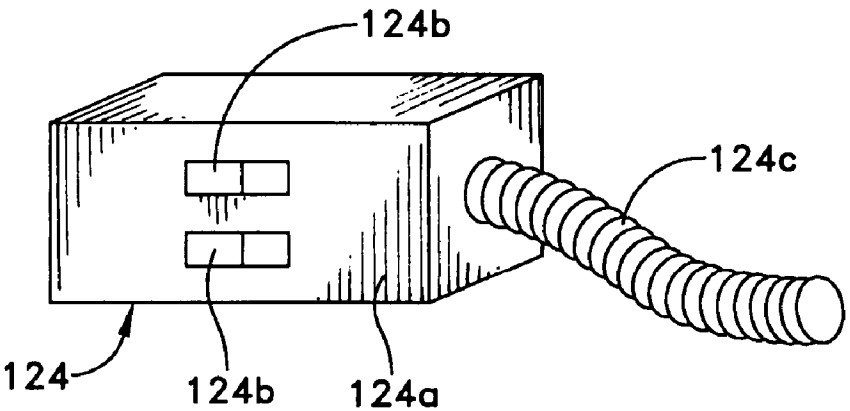
FIG. 2B is an isometric view of a further embodiment of a switch.
Figure 2A:
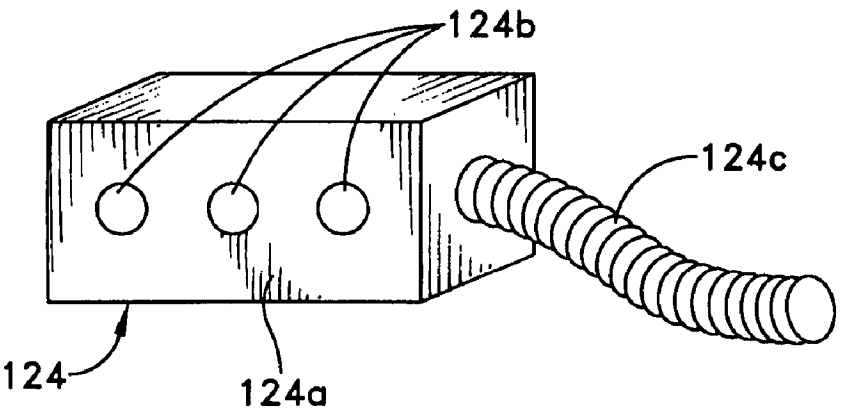
FIG. 2A is an isometric view of an embodiment of a switch.

FIG. 2A discloses another embodiment of the switch (124) having three buttons (124*b*). The first button (124*b*) is pressed to provide an off position. The second button (124*b*) is pressed to turn on air only for delivery through the hose (102) and the nozzle section (104). A third button (124*b*) turns on the delivery of insulation, only after the air has been turned on by activating the second button (124*b*). Internal circuit logic allows any button (124*b*) to be pressed to cease the flow of insulation without ceasing the flow of air, followed by pressing the first button (124*b*) to an off position. Thus, the air is turned on to prevent clogging of the hose (102) and nozzle section (104) before insulation delivery, and after insulation delivery has ceased.

FIG. 2B discloses another embodiment of the switch (124) having a double ganged switch (124*b*). One lever switch (124*b*) switches between two positions to turn air on and off, respectively. Another lever switch (124*b*) switches between two positions to turn insulation delivery on and off, respectively.

Figure 3:
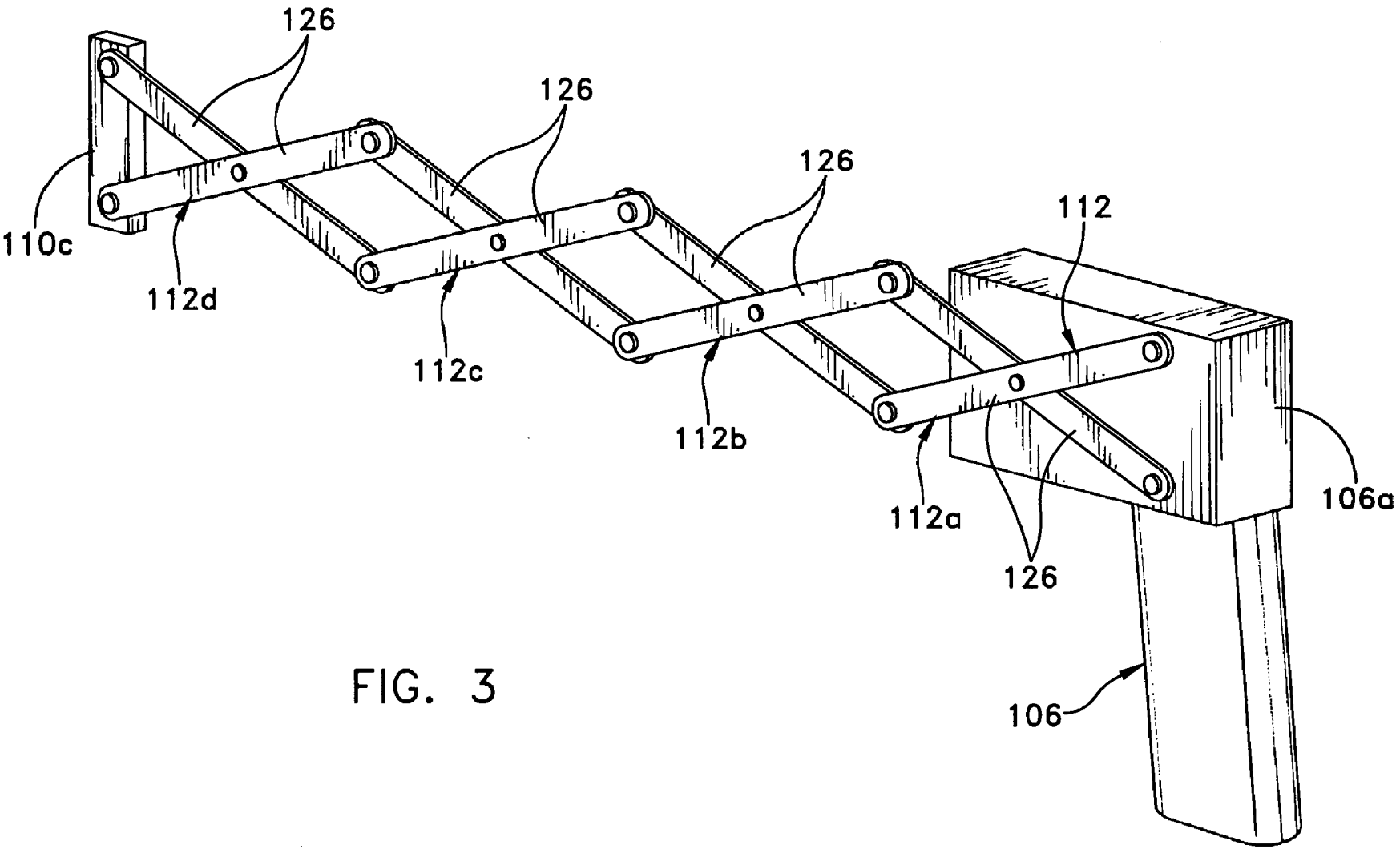
FIG. 3 is an isometric view of an embodiment of a holder extensible section.

FIG. 3 discloses another embodiment of the extensible section (112) attached to the frame (106*a*) of the holder (106). According to the extensible section (112) disclosed by FIG. 3, the cantilever beam sections (112*a*), (112*b*), (112*c*) and (112*d*) are defined by pairs of crossing beams (126). Each pair of beams (126) pivot where they cross one another, and successive pairs of beams (126) are pivotally connected end to end, for extending as an unfolding, cantilever beam. Accordingly, said another embodiment of the extensible section (112) comprises, an extensible cantilever beam having multiple cantilever beam sections (112*a*), (112*b*), (112*c*) and (112*d*) that are pivotally mounted to one another end to end for lengthwise extension.

Figure 4A:
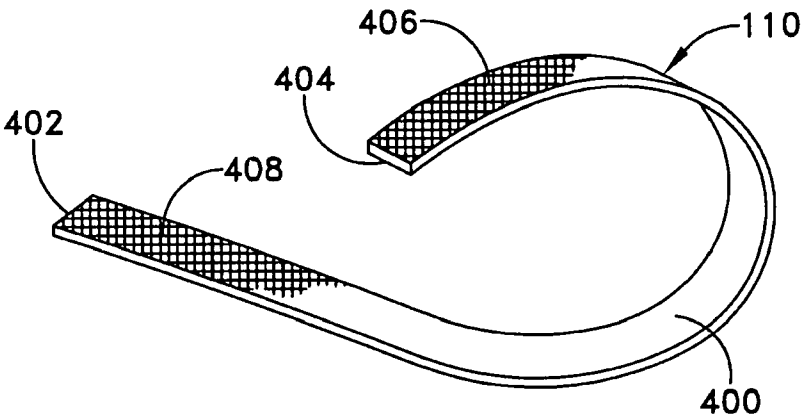
FIG. 4A is an isometric view of an embodiment of a nozzle section holder.

FIG. 4A discloses another embodiment of the nozzle section holder (110) in the form of a flexible strap (400) having free end portions (402) and (404). According to an embodiment of the invention, the free end portions (402) and (404) of the strap (400) interlock by being tied together to secure the nozzle section (104) to the nozzle section holder (110). According to an alternative embodiment of the invention, the free end portions (402) and (404) of the strap (400) interlock by interlocking hook and loop fasteners, VELCRO™, for example, which is in the form of an array of flexible shape memory hooks (406) on either of the free end portions (402) or (404), which interlock with an array of flexible shape memory loops (408) on the other of the free end portions (402) or (404). The hooks (406) and the loops (408) disconnect by manually pulling them apart.

Figure 4B:
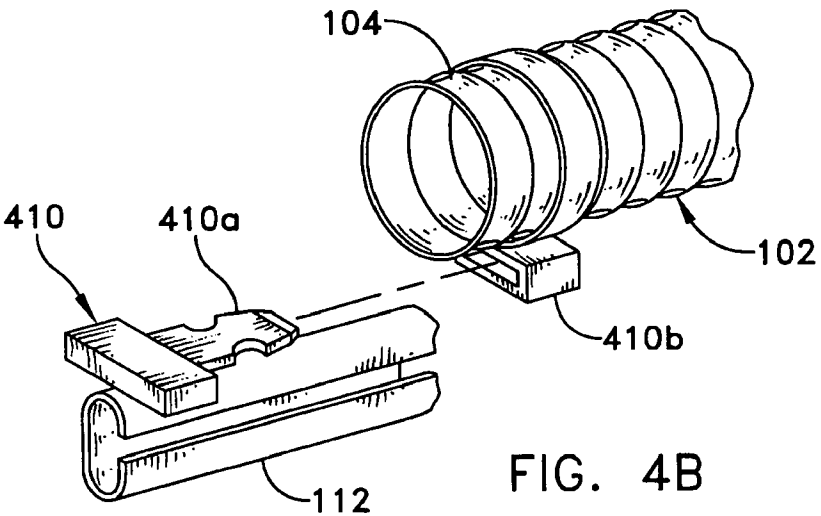
FIG. 4B is an isometric view of another embodiment of a nozzle section holder.

FIG. 4B discloses another embodiment of the nozzle section holder (110) in the form of a disconnect coupling (410). One embodiment of the disconnect coupling (410)

has a bayonet (410*a*) that interlocks for disconnection within a releasable bayonet socket (410*b*). One section of the nozzle section holder (110) in the form of the disconnect coupling (410) is mounted on the extensible section (112) of the holder (106). Another section of the nozzle section holder (110) in the form of the disconnect coupling (410) is mounted on the nozzle section (104) of the hose (102). The bayonet (410*a*) and releasable bayonet socket (410*b*) disconnect from each other in a known manner.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. An insulation delivery apparatus having a nozzle section and a hose attached to an insulation impelling apparatus impelling insulation through the hose, the insulation delivery apparatus further comprising:

a holder having a hose holder holding the hose and a nozzle section holder holding the nozzle;

the nozzle section holder being mounted on an extensible section of the holder; and the holder being graspable with one hand of an operator while the extensible section of the holder is manually manipulated by the other hand of the operator to extend the extensible section, the hose and the nozzle section, or to retract the extensible section, the hose and the nozzle section to a closer location relative to said operator, while impelling said insulation through the hose.

2. The insulation delivery apparatus as in claim 1 wherein, the hose holder slidably holds the hose.

3. The insulation delivery apparatus as in claim 1 wherein, the hose holder comprises a ring through which the hose is slidable.

4. The insulation delivery apparatus as in claim 1 wherein, the nozzle section holder comprises a clamp ring to encircle and tighten around the nozzle section.

5. The insulation delivery apparatus as in claim 1 wherein, the extensible section is an extensible cantilever beam having extensible cantilever beam sections.

6. The insulation delivery apparatus as in claim 1 wherein, the extensible section is an extensible cantilever beam having telescopic sections.

7. The insulation delivery apparatus as in claim 1 wherein, the extensible section comprises an extensible cantilever beam having multiple cantilever beam sections that are slidably mounted to one another for lengthwise extension.

8. The insulation delivery apparatus as in claim 1 wherein, the extensible section comprises an extensible cantilever beam having multiple cantilever beam sections that are pivotally mounted to one another for lengthwise extension.

9. The insulation delivery apparatus as in claim 1 wherein, the extensible section comprises multiple beam sections;

the multiple beam sections comprise pairs of crossing beams, wherein each pair of the crossing beams pivot where they cross one another; and successive pairs of the crossing beams are pivotally connected end to end.

10. The insulation delivery apparatus as in claim 1 wherein, the nozzle section holder comprises a ring clamp; and the hose holder comprises a ring through which the hose is slidable.

11. The insulation delivery apparatus as in claim 1 wherein, the nozzle section holder comprises a strap having end portions that overlap and tie together.

12. The insulation delivery apparatus as in claim 1 wherein, the nozzle section holder comprises a strap having end portions that overlap and the end portions of the strap interlock by having an array of flexible shape memory hooks on one of the end portions of the strap that interlock with an array of shape memory loops on another of the end portions of the strap.

13. The insulation delivery apparatus as in claim 1 wherein, the nozzle section holder is a quick disconnect coupling, a first portion of which coupling is on the holder; and a second portion of which coupling is on the nozzle section, the second portion of which coupling releasably interlocks with the first portion of which coupling.

14. The insulation delivery apparatus as in claim 13 wherein, the first portion of the quick disconnect coupling is on the extensible section of the holder, and the second portion of the quick disconnect coupling is on the nozzle section.

15. The insulation delivery apparatus as in claim 1 wherein, a first portion of the nozzle section holder is on the extensible section of the holder, and a second portion of the nozzle section holder is on the nozzle section.

16. The insulation delivery apparatus as in claim 15 wherein, the first portion of the nozzle section holder and the second portion of the nozzle section holder comprise a disconnect coupling.

17. The insulation delivery apparatus as in claim 15 wherein, the nozzle section holder is a disconnect coupling.

18. The insulation delivery apparatus as in claim 15 wherein, the hose holder slidably holds the hose.

19. The insulation delivery apparatus as in claim 15 wherein, the extensible section is an extensible cantilever beam having extensible cantilever beam sections.

20. The insulation delivery apparatus as in claim 15 wherein, the extensible section comprises beam sections, and the beam sections comprise pairs of crossing beams, wherein each pair of the crossing beams pivot where the cross one another; and successive pairs of the crossing beams are pivotally connected end to end.

* * * * *